United States Patent [19]

Norström et al.

[11] Patent Number: 5,023,049

[45] Date of Patent: Jun. 11, 1991

[54] PRECIPITATION HARDENING TOOL STEEL FOR MOULDING TOOLS AND MOULDING TOOL MADE FROM THE STEEL

[75] Inventors: Lars-Åke Norström; Anders Cederlund; Henrik Jespersson, all of Hagfors, Sweden

[73] Assignee: Uddeholm Tooling Aktiebolag, Hagfors, Sweden

[21] Appl. No.: 488,004

[22] PCT Filed: Nov. 3, 1988

[86] PCT No.: PCT/SE88/00592

§ 371 Date: May 10, 1990

§ 102(e) Date: May 10, 1990

[87] PCT Pub. No.: WO89/05869

PCT Pub. Date: Jun. 29, 1989

[30] Foreign Application Priority Data

Dec. 23, 1987 [SE] Sweden ..... 8705140
Mar. 22, 1988 [SE] Sweden ..... 8802914
Apr. 11, 1988 [SE] Sweden ..... 8801313

[51] Int. Cl.[5] ..... C22C 38/44

[52] U.S. Cl. ..... 420/91; 420/108; 148/335; 148/328

[58] Field of Search ..... 420/90, 91, 92, 108; 148/332, 335, 328

[56] References Cited

U.S. PATENT DOCUMENTS 3,713,905 1/1973 Philip et al. ..... 420/91
3,824,096 7/1974 Asada et al. ..... 148/328

FOREIGN PATENT DOCUMENTS 1196212 6/1970 United Kingdom ..... 420/91

*Primary Examiner*—Deborah Yee
*Attorney, Agent, or Firm*—Armstrong, Nikaido, Marmelstein, Kubovcik & Murray

[57] ABSTRACT

The invention relates to a precipitation hardening tool steel for mould tools. The steel contains, expressed in weight-%:

0.01–0.1 C
from traces to max 2 Si
0.3–3.0 Mn
1–5 Cr
0.1–1 Mo and Ni as a toughness and hardenability improving element, and Ni and Al as a compound and/or Cu for precipitation hardening purposes, wherein the contents of Ni and Al and/or Cu amount to 1–7 Ni
1.0–3.0 Al and/or
1.0–4.0 Cu, wherein $1.5 \times Al + Cu \geqq 2.0$, balance essentially only iron, impurities and accessory elements in normal amounts. The invention also relates to a mould tool made from the steel according to the invention.

28 Claims, 3 Drawing Sheets

PRECIPITATION HARDENING TOOL STEEL FOR MOULDING TOOLS AND MOULDING TOOL MADE FROM THE STEEL

TECHNICAL FIELD

This invention relates to steel metallurgy and to tooling and more particularly to a precipitation hardening tool steel for moulding tools, i.e. tools of the type which have a moulding cavity for moulding plastics or metals, e.g. aluminum, magnesium and zinc, through, e.g., injection moulding, compression moulding, extrusion or for die-casting. Extrusion dies are also included in the concept of moulding tools.

BACKGROUND OF THE INVENTION

For plastic moulding, e.g. through injection moulding or through compression moulding, for die casting, and for the extrusion of metals, e.g. aluminum, magnesium and zinc, there are used tools (moulds and dies, respectively) made from tool steel. These tools are often very large and have cavities with very complicated designs.

In order for the tools to exhibit the desired performance and to have the desired working life, the tool steel has to satisfy a number of different features, depending on how and for what purposes the tool is to be used. Usually the stresses on the tools are high, and include mechanical as well as thermal stresses, and also various forms of wear. Basically, the tool steel should have a high and uniform hardness, even when in the form of bodies having large dimensions, while at the same time as it should have a sufficient toughness for the use in question.

Now, usually tough-hardening steels of type grade AISI P20 (0.35% C-0.4% Si-0.8% Mn-1.8% Cr-0.4% Mo) are used all over the world as a tool material for plastic moulding and for zinc die-casting. Such tool steels are usually delivered from the steel manufacturer in the tough hardened condition, i.e. hardened and high temperature tempered to a hardness level of about 33 HRC. The tools then are made from such steels and, the tools are usually also used in this hardened, tempered condition. In those cases when higher hardness is needed in the tool, which recently has become more and more common, the finished tool has to be rehardened and tempered, which gives rise to increased risk of cracking and dimension changes of the tool which are difficult to resolve. These tough hardening steels, in other words, have evident drawbacks, which cause problems for the steel manufacturer, as well as for the tool maker and/or tool user, namely:

The steels are complicated to manufacture, since they require specific intermediate annealing operations to be performed by the steel manufacturer to eliminate the risk of cracking during manufacture. The steels also require a finishing, full tough hardening operation.

The steels strongly limit the possibilities of, utilizing the higher hardnesses of the tools when required, and they therefore reduce the end user's flexibility in terms of obtaining appropriate tool features.

It is possible to improve the possibility of achieving desired hardness levels by adding alloying elements to the steel, which may give rise to so called precipitation hardening, i.e. increase of the hardness of the steel through a simple heat treatment operation (ageing). The AISI-standardized grade P21 steel having the nominal composition: 0.20% C-0.3% Si-0.3% Mn-4% Ni-1.2% Al, is an example of a tool steel of this type which has been long known.

A steel having the nominal composition 0.15% C-0.3% Si-0.8% Mn-3.0% Ni-0.3% Mo-1.0% Cu-1.0% Al (U.S. Pat. No. 3,824,096) is a considerably newer example of a similar type steel. In both cases aluminum, in the latter case also copper, is used as a precipitation hardening alloying addition. The combination of alloying elements of these steels, however, will cause the steels after cooling from high temperature (in the austenitic state), depending on dimension and cooling procedure, to have a structure consisting of hard martensite (>40 HRC) or softer bainite/ferrite or mixtures thereof. Therefore such steels have to be tempered (aged) by the steel manufacturer and are usually delivered in the as aged condition in the hardness range of 35–40 HRC. The precipitation hardening effect moreover is comparatively weak in these steels, and hardness levels exceeding 40 HRC are practically not possible to achieve for these steels through precipitation hardening. Today no suitable low alloyed steels exist which can eliminate the above mentioned drawbacks of the conventional tough-hardening steels. Theoretically, the very high alloyed marageing steels and certain precipitation hardening stainless steels may have the desired properties, but these steels are too expensive for most technical fields of application.

BRIEF DISCLOSURE OF THE INVENTION

The object of the invention is to provide a precipitation hardened, low alloyed steel, which avoids the above mentioned drawbacks of the known tough hardening steels, and it is also an object of the invention to open new opportunities for utilizing high hardness levels of such steels in forming steel tools.

Moreover, for certain applications, e.g. for extrusion dies, the steel of this invention may replace steels of the type which are delivered in the soft annealed condition, and which, after the manufacture of the tool, have to be hardened and tempered. In this case the steel of the present invention provides an opportunity to manufacture a finished tool in a much shorter time than normal. Due to the simple heat treatment, the steel may be conveniently heat treated by the tool maker instead of having to be sent to a special workshop for heat treatment.

More particularly the invention relates to a steel having the following properties:

After cooling from hot working temperature, e.g. from forging or rolling operations, the steel, for large dimensions as well as for small dimensions, i.e. after slow as well as after fast cooling, has a comparatively soft and tough microstructure, in which the majority of the structure consists of lath-martensite, having a hardness in the range 30–38 HRC.

The steel thereafter exhibits a substantially higher hardness, that is a hardness above 42 HRC, without complicating dimensional changes, after a simple heat treatment operation, e.g. an ageing step at a comparatively low temperature.

The ability to obtain the above mentioned increase in hardness is not achieved upon slow cooling after heat treatment.

The steel has a sufficient toughness for the intended use as a moulding tool for the moulding of plastics or for the compression moulding of metals.

The steel has a good polishability, the ability to be etched phototechnically, has a good spark machinability, and a good weldability, which are useful when the steel is to be used for plastic moulding tools.

The steel, when it is used as a hot work steel, has a good tempering resistance, and it will not be overaged during normal use.

The steel, when it is used for extrusion components, has a good hot strength and a good nitridability.

A tool steel which has these properties avoids or eliminates the above mentioned drawbacks of the known tough-hardening steels, for both the steel manufacturer, as well as for the tool maker and the tool user, and offers entirely new opportunities to use higher hardnesses in tools depending on the circumstances. The steel moreover can be used for certain applications where conventional tool steels which are delivered in the soft annealed condition are used, and in these uses, due to the simple heat treatment operation that is involved, the steel provides an opportunity to finish (manufacture and heat treat) a tool much faster than with conventional tool steels.

The steel according to the invention contains, besides iron, 0.01–0.1% C, from traces to maximum 2% Si, 0.3–3.0% Mn, 1–5% Cr, with the total content of Mn+Cr preferably amounting to at least 3%, and 0.1–1% Mo, as the basic composition of the steel. In addition the steel contains Ni as a general toughness and hardenability improving element. Finally, the steel contains a precipitation hardening element or combination which is Ni and Al in combination as a compound, or optionally Cu together with Ni and Al in combination. The contents in the steel of Ni and Al, and optionally Cu, are 1–7% Ni, 1.6–3.0% Al, and 1.8–4.0% Cu. Besides the above specified elements, the steel contains essentially only iron, impurities and accessory elements in normal amounts. Unless otherwise indicated, all percentages refer to weight percentages.

Within the scope of the invention, the following guidelines are recommended as far as the preferred amounts of precipitating hardening elements are concerned.

In the case when the precipitation hardening element is based only upon the combination of Ni and Al, in which case the steel preferably does not contain Cu in amounts greater than that of an impurity, the steel preferably contains 3–7% Ni and 1.5–3.0%, more preferably 1.6–3.0% Al. The nickel in this case exists in the steel in order to contribute to the desired toughness of the steel and also as a precipitation hardening element together with Al, in the form of a compound of Ni and Al.

In the case when the precipitation hardening is based upon Cu together with Ni and Al in combination, the steel preferably contains 2–7% Ni, 1.0–4.0% Al, preferably 1.6–3.0% Al, and 1.0–3.0% Cu or, more preferably, 1.8–3.0% Cu. The nickel in this case, as in the first mentioned case, exists in the steel in order to contribute to the desired toughness and hardenability of the steel and also as a precipitating element in the form of a nickel-aluminum compound. It is, however, not only the Ni, Cu and/or Al which are important. All alloying elements mentioned above, except possibly Si, are of great importance to the achievement of those features which are objects of the invention. Further, the specific combination of these elements, in the indicated amounts, is crucial to obtaining the desired tool steel properties.

The most important effects of each of the alloying elements can be briefly explained in the following way.

CARBON

This element is of crucial importance for the strength (hardness) and the toughness of the steel after heat treatment and forging, i.e. for the structure which is mainly lath-martensite with the steel in the non-aged condition. In the case of low carbon contents (<0.10%) the martensite will be comparatively soft and tough and will result in a steel which is extremely useful already in the untempered condition. In the case of higher carbon contents, the hardness of the martensite will increase rapidly as the carbon content is increased, and at the same time the toughness is diminished, which means that the martensite in this case must be tempered. The carbon content in the steel is in the range 0.01–0.10%, preferably in the range 0.03–0.08%.

SILICON

This element does not have any significant importance for the steel of the present invention, but Si can exist as an accessory element (as a remainder from the deoxidation of the molten steel). Silicon, however, is a ferrite stabilizing element and therefore must not be present in amounts higher than 2%, and preferably the steel contains no more than 1% Si.

MANGENESE AND CHROMIUM

These elements to some extent have the same function, and additions of sufficient amounts of manganese and chromium are of significant importance to the steel of the present invention for the following reasons:

The steel during hot working should have an entirely dominating austenitic microstructure.

The hardenability of the steel, i.e. its ability to transform to martensite and not to ferrite during slow cooling, should be sufficiently high.

The $M_s$-temperature of the steel, i.e. the temperature where martensite starts to form during cooling, must be sufficiently low, that the precipitation hardening will not occur already during a slow cooling subsequent to hot working.

Manganese as well as chromium bring about the desired effects as far as all these three above considerations are concerned, but manganese gives the most pronounced effects. Amounts of manganese, which are too high however, will cause unfavourable tendencies to brittleness of the steel of the present type, so that a combination of manganese and chromium must be used in order to achieve the optimal result. Additions of these elements which are suitable for this invention are:

Mn 0.3–3.0%
Cr 1–5%
Mn+Cr $\geqq$3%

NICKEL

This element is of primary importance to the steel of the present invention from several reasons. Additions of nickel produce desired effects similar to those of manganese and chromium, as has been explained above, and nickel also brings about favourable improvements of the toughness properties in a manner known per se. When the precipitation hardening is brought about through the additions of aluminum (see above and below), the active precipitation hardening phase moreover is a compound of nickel and aluminum, wherein there is required a higher content of nickel in order that the nickel has an opportunity to contribute to the desired precipitation. If, on the other hand, only copper is used to bring about the precipitation hardening (see below), the nickel will not take part in the effective precipitation reaction, and therefore nickel in that instance is not required in the same way as in the case when aluminum is also added.

The following nickel contents are suitable according to the invention:

3–7% Ni in the case of aluminum/nickel precipitation

2–7% Ni in the case of aluminum/nickel and copper precipitation

MOLYBDENUM

The fact that the contribution of the original martensite to the strength of the steel can be effectively used is an important reason why the steel according to the invention can achieve such high hardnesses after ageing. The most important contributions to the strength of the lath martensite which is formed subsequent to hot working and cooling are due to a high density of dislocations and sub-grain boundaries in the microstructure, respectively. Such microstructures have a tendency to be decomposed and softened when the steel is tempered, i.e. when the structures are subject to temperatures in the range where the ageing treatment is normally performed. Therefore, an unfavourable decomposition of the microstructure during ageing has to be prevented. Molybdenum here plays the most important rôle, and even small additions of this element have the ability to greatly delaying such a decomposition up to temperatures about 600° C.

According to the invention, suitable molybdenum contents lie in the range 0.1–1.0%.

ALUMINUM

This element together with nickel will form a stoichiometric compound consisting of NiAl. The NiAl-phase is soluble in the austenite even when high contents of aluminum and nickel are involved, but in martensite and in ferrite the NiAl-phase will produce fine dispersed precipitations, which may cause strong precipitation hardening effects (that is, hardness increases).

In cases wherein the precipitation hardening is based only on aluminum and nickel, suitable aluminum contents are in the range 1.5–3.0%, preferably 1.6–3.0%, and more proferably at least 1.7% Al.

COPPER

This element has a high solubility in austenite but a quite limited solubility in martensite and in ferrite. High contents of copper therefore can be dissolved in the steel and be maintained in solution during hot working and during cooling. When ageing the martensite, fine dispersed precipitation of particles consisting of pure copper may be obtained, to cause strong precipitation hardening effects. As in the case of aluminum, the effect will increase with increased copper content up to a certain limit. As the precipitation in this case is not primarily dependent on any further alloying element, the choice of the nickel content in this case will not have the same importance as when aluminum exists in the steel and is precipitated as a compound with nickel.

By using aluminum/nickel and copper at the same time in sufficient amounts in the steel, it is possible to obtain a simultaneous precipitation of fine dispersed NiAl and copper when the steel is subject to ageing. This means that the two precipitation effects are partly cumulatively added to one another, and also that a wider temperature range, which is favourable for effective ageing, may be used. However, it is a drawback of the addition of copper that the return scrap will be less valuable, and also that the handling of the return scrap in the steel plant will be more complicated, since the scrap which contains copper in many cases cannot be used as a raw material for non-copper containing steel grades without substantial problems. From this point of view, therefore, the non-copper containing embodiment of the steel of the present invention is preferred.

When the precipitation hardening is, however, based on the presence of aluminum and nickel as well as copper in the steel, suitable aluminum, and copper contents in the steel are within the ranges:

Al: 1.0–3.0%, preferably at least 1.5%, and more preferably 1.6–3.0%

Cu: 1.0–4.0%, preferably at least 1,5%, and more preferably 1.8–4.0%

AGEING

In order to achieve the desired hardnesses the steel, is subjected to ageing at a temperature between 400°–600° C. for 0.5–5 h. Preferably the steel is aged for 1 to 3 h at about 500° C. The hardness increases from 33–37 HRC to more than 42 HRC or to even 45 HRC and higher through the ageing treatment, and in certain cases can increase all the way up to about 50 HRC. The favourable lath-martensitic structure, which the steel obtains when cooled to ambient temperature from the hot working temperature, is substantially maintained at the ageing treatment. Herein the molybdenum, as above mentioned, plays a most important rôle of preventing an unfavourable decomposition of the lath-martensitic microstructure during ageing. Therefore, through the combination of the selection of a suitable basic composition of the steel and of suitable precipitation elements, it is possible, through the ageing treatment, to obtain a hardness, through precipitation hardening, which is cumulatively added to the hardness which was obtained when the steel was cooled to ambient temperature (and which hardness is comparatively high because of the favourable lath-martensitic microstructure of the steel). The ageing treatment can either be performed on the tool blank or on the finished tool as the user may wish or depending on the hardening equipment or on other circumstances.

Further features and aspects as well as advantages of the invention will be apparent from the following examples of steels according to the invention and from the following description of achieved results.

BRIEF DESCRIPTION OF DRAWINGS

In the following description of some examples of steels of the invention and in the statement of achieved results, reference will be made to the accompanying drawings, in which.

DESCRIPTION OF TESTS PERFORMED AND STATEMENT OF RESULTS

The tested steels had the compositions which are set forth in Table 1. In addition to the elements which are listed in the table, the steels contained impurities and accessory elements in normal amounts, balance iron. All contents refer to weight-%.

TABLE 1

Chemical composition (weight-%) of the tested steel alloys

| Steel No. | C | Si | Mn | Cr | Ni | Mo | Al | Cu | 1.5 Al + Cu |
|---|---|---|---|---|---|---|---|---|---|
| 1 | 0.05 | 0.22 | 1.3 | 2.5 | 2.5 | 0.32 | 0.01 | 0.01 | |
| 2 | 0.05 | 0.36 | 1.6 | 2.5 | 2.6 | 0.30 | 1.0 | 0.01 | 1.5 |
| 3 | 0.05 | 0.33 | 1.5 | 2.3 | 3.1 | 0.30 | 1.6 | 0.01 | 2.4 |
| 4 | 0.05 | 0.34 | 1.4 | 2.4 | 4.2 | 0.32 | 1.9 | 0.01 | 2.9 |
| 5 | 0.05 | 0.29 | 1.4 | 2.3 | 5.2 | 0.30 | 2.3 | 0.01 | 3.5 |
| 6 | 0.02 | 0.30 | 1.3 | 2.3 | 5.3 | 0.32 | 2.3 | 0.01 | 3.5 |
| 7 | 0.05 | 0.22 | 1.4 | 2.3 | 2.6 | 0.30 | 0.01 | 1.5 | 1.5 |
| 8 | 0.05 | 0.21 | 1.4 | 2.3 | 2.6 | 0.32 | 0.01 | 3.0 | 3.0 |
| 9 | 0.05 | 0.32 | 1.5 | 2.2 | 3.2 | 0.32 | 1.7 | 2.0 | 4.55 |

The steels of Table 1 were manufactured in the form of 50 kg laboratory melts which were cast to 50 kg ingots. The ingots were heated to about 1200° C. and were hot forged to flat rods having a cross-section 120×30 mm. After forging the rods were allowed to cool freely in air to room temperature.

The steel No. 1 is a basic composition, without any addition of precipitation hardening alloying elements. All the other steels contain precipitation hardening additions in the form of Al (Nos. 2–6), Cu (Nos. 7 and 8), and Al+Cu (No. 9).

After forging and cooling to room temperature all the steels exhibited an almost fully lath-martensitic microstructure. The initial hardness of all the steels was in the range 33–37 HRC, as shown in FIG. 1.

Figure 1:
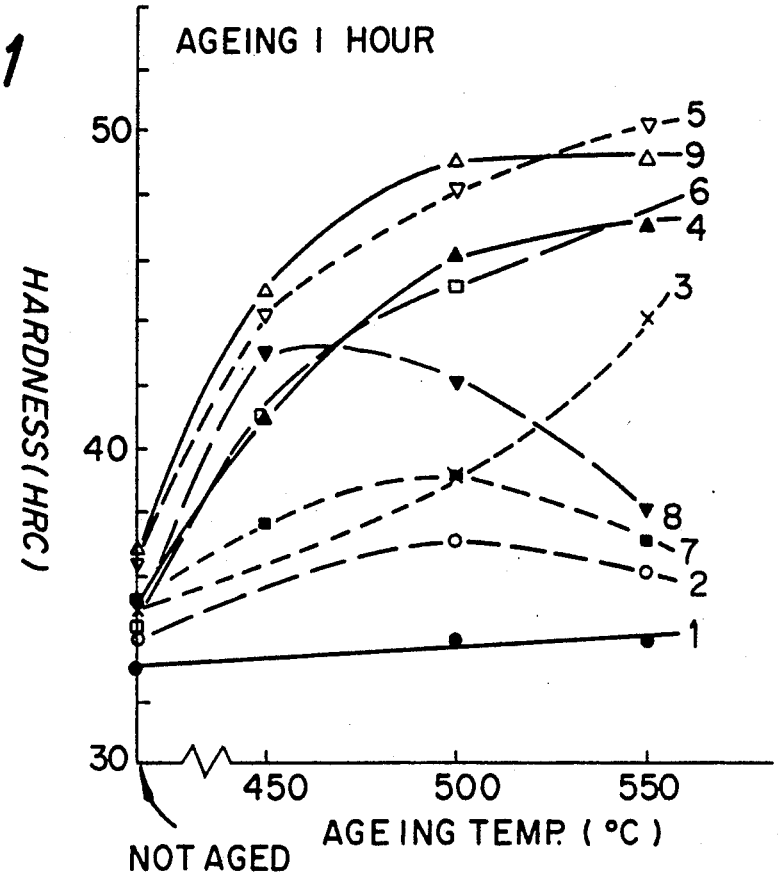
FIG. 1 is a diagram which illustrates the hardness of the examined steels after ageing for 1 h at different temperatures between 450° and 550° C.
Figure 2:
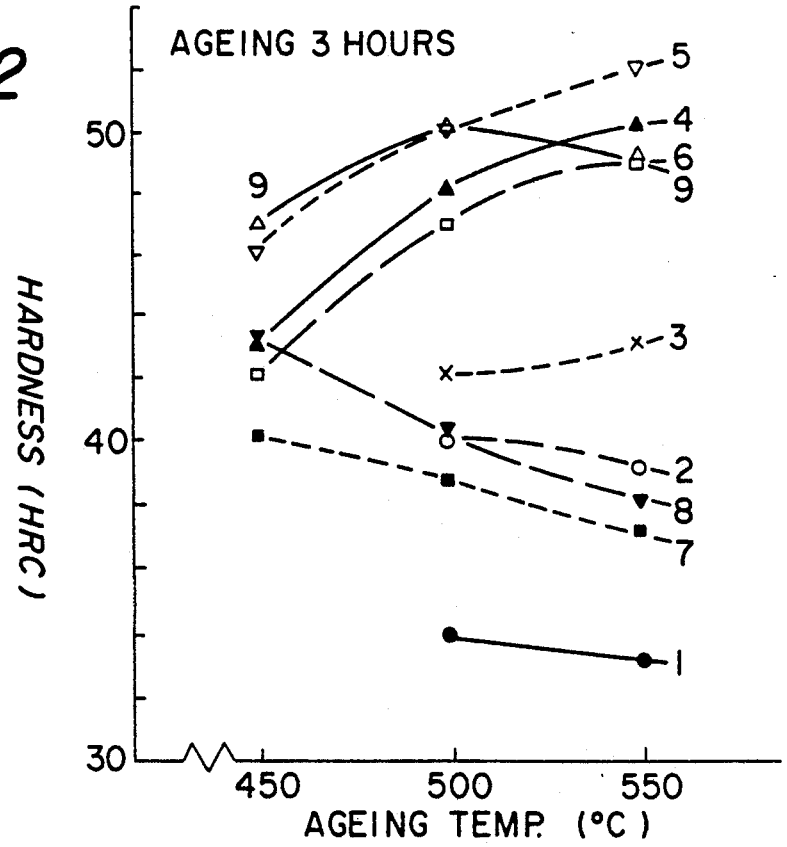
FIG. 2 is a diagram which shows the hardness of the same steels after ageing for 3 h at the same temperatures.

FIGS. 1 and 2 further teach that a simple ageing treatment for 1 to 3 h at 500° to 550° C. can increase the hardness significantly and that this affects the majority of the steels. The best values were obtained with the steels Nos. 3–6 and No. 9, which contain from 1.6 to 2.3% Al, and 1.7% Al+2.0% Cu, respectively.

Figure 3:
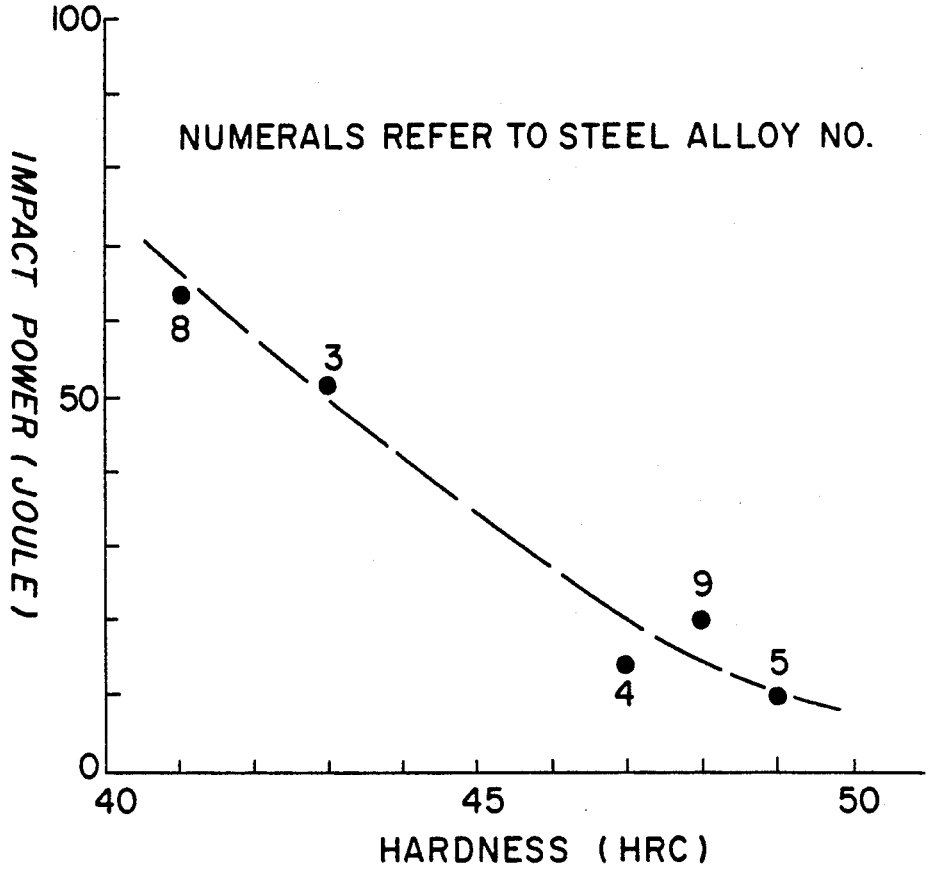
FIG. 3 is a diagram showing the impact strength of the steels of the invention at 200° C. as a function of the hardness at room temperature after ageing.

For uses such as, e.g., plastic moulding tools, the toughness is of minor importance as compared to other properties of the steel, but of course the steel must have a sufficient toughness for those temperatures which the tool may reach during use, namely temperatures within a temperature range which normally ranges from room temperature up to about 200° C. The impact strength values for some of the steels in the as aged condition and for one of the steels in the non-aged condition at room temperature and at 200° C., respectively are set forth in Table 2. Further, the impact strength at 200° C. as a function of the hardness is also set forth in FIG. 3.

In summary, the impact strength tests show that the steel of the present invention has an equal or higher toughness as compared to the established tough hardening steels of a comparable hardness, and that that reduction of toughness which accompanies an increase in hardness will occur in a manner which is normal to any steel. The toughness of the steels of the present invention therefore is sufficient for the intended fields of use.

TABLE 2

Impact strength (Charpy V, transversal test) at room temperature and at 200° C., respectively, at different conditions of hardness after ageing

| Steel No. | $KV_{RT}$ (Joule) | $KV_{200° C.}$ (Joule) | Hardness (HRC) |
|---|---|---|---|
| 3 | not tested | 52 | 43 |
| 4 | 6 | 14 | 47 |
| 5 | 6 | 9 | 49 |
| 8 | 8 | 63 | 41 |
| 9 | 6 | 20 | 48 |
| 4 | 31 | — | 36 (not aged) |

Figure 4:
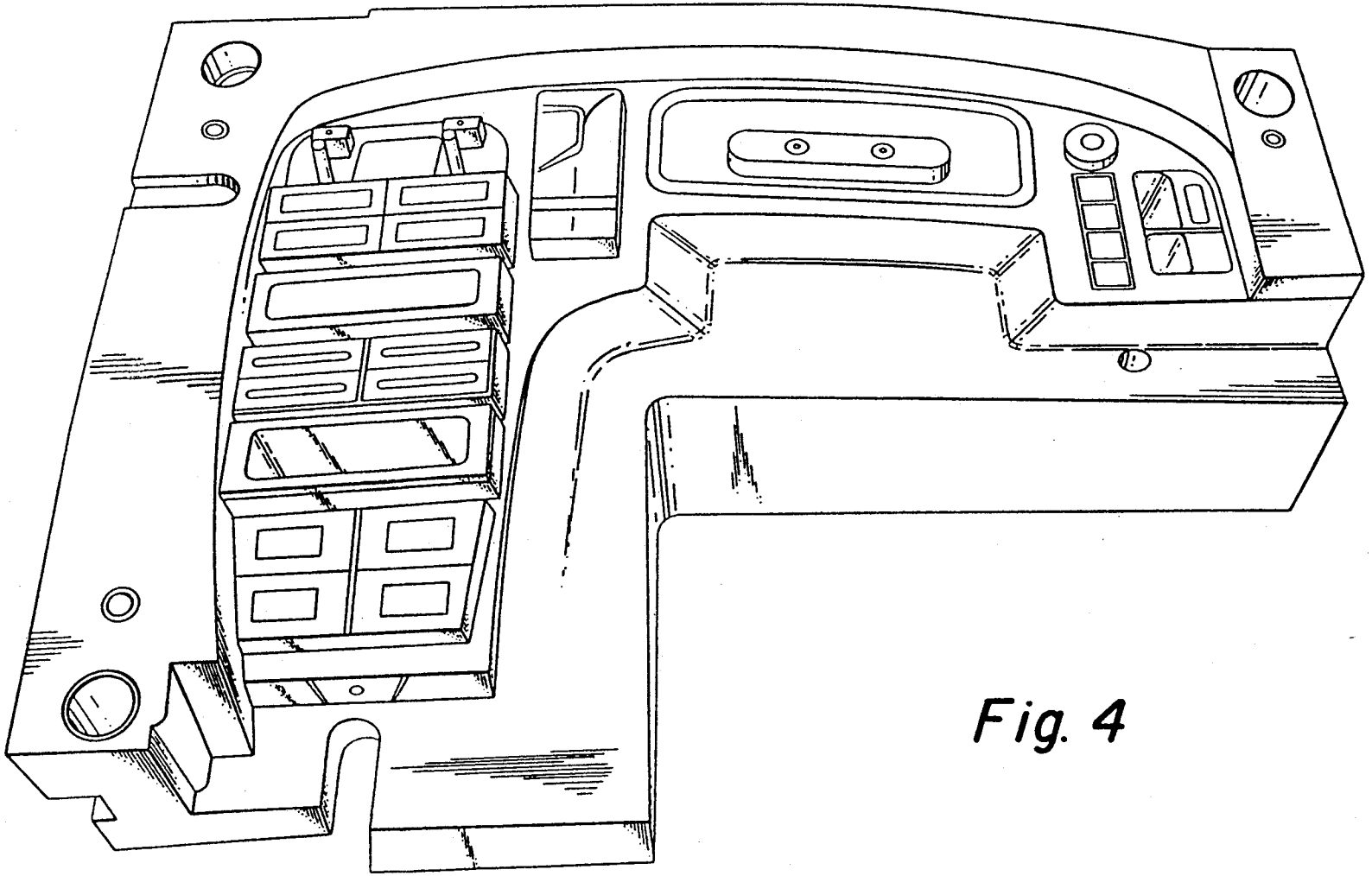
FIG. 4 shows a typical design of a moulding tool of the type for which the steel for the present invention is intended. The tool illustrated in the drawing consists of one-half of a mould for the injection moulding a plastic object.

FIG. 4 shows one-half of a tool intended for the injection moulding of a plastic dash-board of a modern motor-car and illustrates the complexity of an advanced tool for which the steel of the present invention is suitable.

EVALUATION OF RESULTS—PREFERRED EMBODIMENTS

As already has been mentioned in the foregoing, the best results were achieved with steels Nos. 3–6 and No. 9, which contain from 1.6 to 2.3% Al, and 1.7% Al+2.0% Cu, respectively. Much more favourable values were achieved with steel No. 2, which contains 1.0% Al and no copper, and also with steel No. 8, which contains as much copper as 3.0% but no aluminum. From these results one can draw the conclusion that the steel should contain at least 1.6% Al in order to achieve the most desired hardnesses, whether the steel also contains copper or not. If the steel does not contain any copper, the content of aluminum should preferably be more than 1.6%, and more preferably at least 1.7%. The tests have been performed with contents up to 2.3% Al, but there is nothing that indicates that even still higher aluminum contents should not be operable. However, there is an upper limit as far as the saturation of the steel with reference to aluminum content is concerned. For this reason the upper limit has been set at 3.0% Al. While, in the first place, the preferred composition of the steel of the invention is represented by the steels Nos. 4, 5 and 6, and steel No. 9 represents a second version of the invention, while steel No. 8 lies outside the definition range of the present invention. The solubility as far as aluminum is concerned is not affected by the content of copper, which may exist at the same time in the steel, wherefore the copper alloyed steel may contain as much aluminum as the non-copper alloyed steel. For this reason the preferred aluminum content in the copper alloyed steel also is 1.6–3.0% Al. In order to obtain a maximal effect with the addition of copper, the lowest preferable copper content is thought to be 1.8%, while the upper limit for production technical reasons is considered to be 4.0% Cu.

On the basis of the above stated tests, full scale charges (6 tons) of two steels having the compositions (inner and outer analysis limits and nominal composition) according to Table 3 and Table 4 were made. From these steels 2 ton ingots were made, which were hot worked into the shape of rods having dimensions relevant for plastic mould steels. From these rods test specimens were made, which were than tested. The results from the tests verified the results which were achieved with the steels No. 4 and No. 9, respectively.

TABLE 3

| | C | Si | Mn | P | S | Cr | Ni | Mo | Cu | Al | N |
|---|---|---|---|---|---|---|---|---|---|---|---|
| Minimum | .020 | .20 | 1.30 | | .020 | 2.20 | 4.30 | .25 | | 1.70 | |
| Preferred minimum | .025 | .25 | 1.35 | | .025 | 2.25 | 4.40 | .28 | | 1.75 | |
| Nominal composition, appr | .035 | .30 | 1.4 | | | 2.3 | 4.5 | .3 | | 1.85 | |
| Preferred maximum | .045 | .35 | 1.45 | .015 | .035 | 2.35 | 4.60 | .32 | .15 | 1.95 | .015 |
| Maximum | .060 | .40 | 1.50 | .020 | .040 | 2.40 | 4.70 | .35 | .20 | 2.00 | |

TABLE 4

| | C | Si | Mn | P | S | Cr | Ni | Mo | Cu | Al | N |
|---|---|---|---|---|---|---|---|---|---|---|---|
| Minimum | .020 | .20 | 1.30 | | | 2.20 | 3.20 | .25 | 1.80 | 1.60 | |
| Preferred minimum | .025 | .25 | 1.35 | | .010 | 2.25 | 3.30 | .28 | 1.90 | 1.65 | |
| Nominal composition, appr | .035 | .30 | 1.4 | | | 2.3 | 3.4 | .3 | 2.0 | 1.7 | |
| Preferred maximum | .045 | .35 | 1.45 | .020 | .020 | 2.35 | 3.50 | .32 | 2.10 | 1.75 | .015 |
| Maximum | .060 | .40 | 1.50 | .025 | | 2.40 | 3.60 | .35 | 2.20 | 1.80 | |

We claim:

1. Precipitation hardening tool steel for use in the production of mould tools, containing, expressed in weight-%,:

0.01–0.1 C
from traces to max 2 Si
0.3–3.0 Mn
1–5 Cr
0.01–1 Mo wherein the total amount of Mn+Cr is at least 3% and said steel further containing Ni as a toughness and hardenability improving element, and either Ni and Al as a compound or Ni, Al and Cu for precipitation hardening purposes, wherein the contents of Ni and Al and Cu amount to:

1–7 Ni
1.0–3.0 Al and
4.0 max Cu, wherein $1.5\times Al+Cu\geqq 2.0$, balance being essentially only iron, impurities and accessory elements in normal amounts.

2. Tool steel according to claim 1, wherein the steel contains

3–7% Ni
1.5–3.0% Al, and wherein the precipitation hardening is based only on the existence of Ni and Al.

3. Tool steel according to claim 2, containing 1.6–3.0% Al.

4. Tool steel according to claim 3, containing 1.7–3.0% Al.

5. Tool steel according to claim 4, containing 3–7% Ni.

6. Tool steel according to claim 1, containing

2–7% Ni
1.0–3.0% Al, and
1.0–4.0% Cu, the precipitation hardening being based on Cu as well as on Ni and Al as a compound.

7. Tool steel according to claim 6, containing 1.0–3.0% Cu.

8. Tool steel according to claim 6, containing 1.6–3.0% Al and 1.8–4.0% Cu.

9. Tool steel according to claim 6, containing 3–7% Ni and 1.7–3.0% Al.

10. Tool steel according to claim 6, containing 2.5–5% Ni.

11. Tool steel according to claim 6, wherein $1.5\times Al+Cu$ is at least 3%.

12. Tool steel according to any of claims 1–11, containing up to 1% Si.

13. Tool steel according to claim 3, containing 4–6% Ni.

14. Tool steel according to claim 4, containing 2–5% Ni and 2.5–4.0% Cu.

15. Tool steel according to claim 7, containing 2.5–5% Ni, 1–3% Al and 1.5–3.0% Cu.

16. Tool steel according to any of claims 1 to 15, containing 0.02–0.08%, suitably appr 0.05% C.

17. Tool steel according to claim 16, containing 0.03–0.08% C
2–3% Cr
4–5% Ni
0.1–0.6% Mo
1.7–2.5% Al.

18. Tool steel according to claim 17, containing 0.030–0.070% C
0.1–1.0% Si
1–2% Mn
2.0–2.5% Cr
4.2–5.3% Ni
1.7–2.4% Al and copper not more than as impurity.

19. Tool steel according to claim 6, containing 0.03–0.08% C
2.0–2.8% Cr
1–2% Mn
3–4% Ni
0.1–0.6% Mo
1.8–2.5% Cu
1.6–2.0% Al.

20. Tool steel according to claim 1, containing, expressed in weight-%:

0.03–0.08 C,
max 1.0 Si
1–2 Mn,
2.0–2.8 Cr,
4–5 Ni,
0.1–0.6 Mo,
max 0.5 Cu,
1.6–3.0 Al, with the balance essentially only iron, impurities and accessory elements in normal amounts.

21. Tool steel according to claim 20, containing, expressed in weight-%:

0.03–0.08 C,
max 1.0 Si
1–4 Mn, 2.0–2.8 Cr,
3–4 Ni,
0.01–0.6 Mo,
1.8–4.0 Cu,
1.6–2.5 Al, with the balance essentially only iron, impurities and accessory elements in normal amounts.

22. Moulding tool made from a steel which contains, expressed in weight-%:
0.01–0.10 C
from traces to max 2 Si
0.3–3.0 Mn
1–5 Cr
0.1–1 Mo and said steel further containing Ni as a toughness and hardenability improving element, and Ni and Al as a compound or Cu together with a compound of nickel and aluminum for precipitation hardening purposes, wherein the contents of Ni, Al and Cu respectively, amount to:
1–7 Ni
1.0–3.0 Al and
4.0 max Cu,
wherein $1.5 \times Al + Cu \geqq 2.0$, with the balance essentially only iron, impurities and accessory elements in normal amounts, and wherein the dominating phase of the microstructure consists of lath-martensite, and the steel, after having been aged at a temperature between 400° and 600° C. for 0.5 to 5 hours, has a hardness exceeding 42 HRC.

23. Moulding tool made from a steel according to claim 19, wherein the steel has a hardness exceeding 45 HRC.

24. The tool steel as claimed in claim 6 containing 1.5% aluminum and 1.5% copper.

25. The tool steel as claimed in claim 16 containing 0.03 to 0.08% carbon.

26. The tool steel as claimed in claim 16 containing 0.05% carbon.

27. The tool steel as claimed in claim 20 containing:
0.05 C
max 1.0 Si
1.4 Mn
2.4 Cr
4.2 Ni
0.3 Mo
0.01 Cu
1.9 Al.

28. The tool steel as claimed in claim 21 containing:
0.05 C
1.0 Si
1.5 Mn
2.2 Cr
3.2 Ni
0.3 Mo
2.0 Cu
1.7 Al
balance essentially only iron, impurities and accessory elements in normal amounts.

* * * * *